US008757279B2

(12) United States Patent
Hay

(10) Patent No.: US 8,757,279 B2
(45) Date of Patent: Jun. 24, 2014

(54) PIPE IN PIPE PISTON THRUST SYSTEM

(75) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/988,303

(22) PCT Filed: Jul. 13, 2012

(86) PCT No.: PCT/US2012/046812

§ 371 (c)(1),
(2), (4) Date: Jul. 15, 2013

(87) PCT Pub. No.: WO2014/011193

PCT Pub. Date: Jan. 16, 2014

(65) Prior Publication Data

US 2014/0014372 A1 Jan. 16, 2014

(51) Int. Cl.
*E21B 23/08* (2006.01)
*E21B 4/18* (2006.01)

(52) U.S. Cl.
USPC ..... 166/383; 175/230

(58) Field of Classification Search
CPC ..... E21B 23/08; E21B 33/126; E21B 37/04; E21B 33/068; E21B 4/18; E21B 17/1014; E21B 17/1042
USPC ..... 166/383; 175/230
See application file for complete search history.

(56) References Cited

U.S. PATENT DOCUMENTS

| | | | | |
|---|---|---|---|---|
| 4,756,364 | A | 7/1988 | Christensen et al. | |
| 4,962,815 | A | 10/1990 | Schultz et al. | |
| 5,209,304 | A | 5/1993 | Nice | |
| 7,273,109 | B2 * | 9/2007 | Moore et al. | 166/381 |
| 2012/0125686 | A1 | 5/2012 | Hogseth et al. | |

FOREIGN PATENT DOCUMENTS

| | | | |
|---|---|---|---|
| WO | 2010039042 | A2 | 4/2010 |
| WO | 2010039043 | A1 | 4/2010 |
| WO | 2010095949 | A2 | 8/2010 |
| WO | 2010120191 | A2 | 10/2010 |
| WO | 2011005107 | A2 | 1/2011 |
| WO | 2014011193 | A1 | 1/2014 |

OTHER PUBLICATIONS

Foreign Communication from a Related Counterpart Application, International Search Report and Written Opinion dated Mar. 19, 2013, International Application No. PCT/US12/46812, filed on Jul. 13, 2012.

Hay, Richard Thomas, Patent Application entitled "Pipe in Pipe Piston Thrust System", filed on Dec. 17, 2013, U.S. Appl. No. 14/109,537.

* cited by examiner

*Primary Examiner* — Brad Harcourt
*Assistant Examiner* — Wei Wang

(57) ABSTRACT

A pipe in pipe piston thrust system comprises a plurality of piston assemblies configured to sealingly engage a wellbore, a pump configured to transfer a fluid into the wellbore, and a by-pass disposed between a plurality of annuli formed by the plurality of piston assemblies. The by-pass allows for selective communication of the fluid between the plurality of annuli.

20 Claims, 14 Drawing Sheets

PIPE IN PIPE PISTON THRUST SYSTEM

CROSS-REFERENCE TO RELATED APPLICATIONS

This application is a filing under 35 U.S.C. 371 as the National Stage of International Application No. PCT/US2012/046812, filed Jul. 13, 2012, entitled "PIPE IN PIPE PISTON THRUST SYSTEM," which is incorporated herein by reference in its entirety for all purposes.

BACKGROUND

The present application relates to pipe in pipe piston thrust assemblies. Pipe in pipe piston thrust assemblies can be used to provide thrust for a drill bit in a wellbore when, for example, the weight of the tubular string is insufficient to advance the tubular string through a wellbore. However, when a pipe in pipe piston thrust system crosses a horizontal section such as a lateral leak path or a lateral that breaks the piston seal, weight applied to the drill bit may be lost. In these cases, the drill bit can no longer effectively bore further through the subterranean formation.

SUMMARY

In an embodiment, a pipe in pipe piston thrust system comprises a plurality of piston assemblies configured to sealingly engage a wellbore, a pump configured to transfer a fluid into the wellbore, and a by-pass disposed between a plurality of annuli formed by the plurality of piston assemblies. The by-pass allows for selective communication of the fluid between the plurality of annuli.

In an embodiment, a method for traversing a leak path comprises closing a first by-pass through a first piston assembly, opening a second by-pass through a second piston assembly to provide fluid communication to the first piston assembly, axially displacing the first piston assembly and the second piston assembly in a first direction in a wellbore based on the fluid communication with the first piston assembly, closing the second by-pass through the second piston assembly, providing a pressure differential across the second piston assembly, and axially displacing the first piston assembly in the first direction past a lateral path based on the pressure differential across the second piston assembly. The first piston assembly and the second piston assembly are disposed in a wellbore.

In an embodiment, a method for traversing a lateral break comprises sealingly engaging a first piston assembly with a wellbore, increasing pressure across the first piston assembly, displacing the first piston assembly axially within the wellbore in a first direction, sealingly engaging a second piston assembly with the wellbore to create a first annulus between the first piston assembly and the second piston assembly, opening a by-pass across the second piston assembly to allow fluid communication to the first annulus, displacing the first piston assembly and the second piston assembly axially within the wellbore in the first direction while maintaining the first annulus, opening a by-pass across the first piston assembly when pressure decreases across the first piston assembly, and closing the by-pass across the second piston assembly to increase pressure across the second piston assembly.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1A:
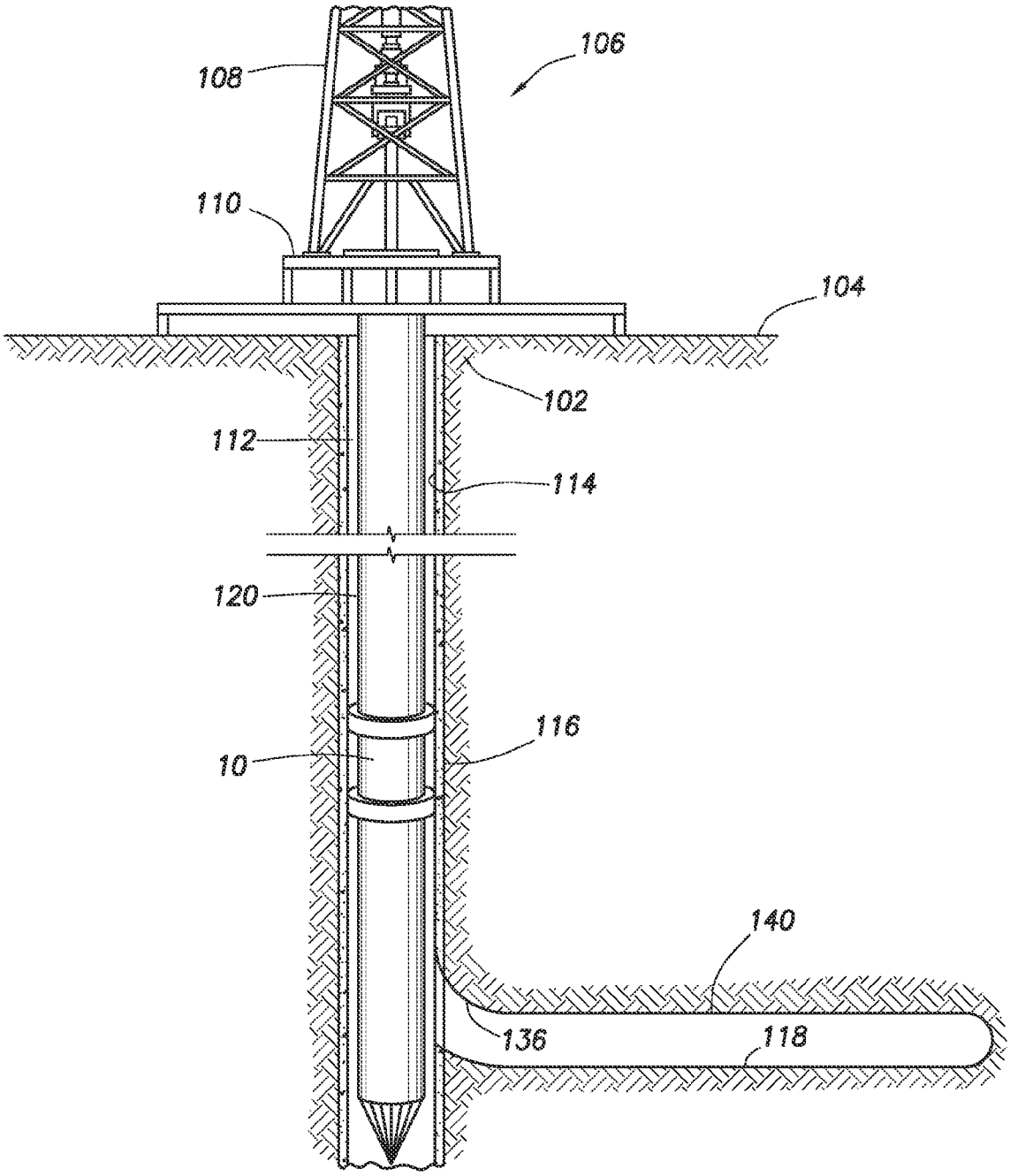
FIG. 1A is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

Traditional drilling systems utilize a drill bit disposed on the end of a drill string to form a wellbore in a subterranean formation. Force can be applied to the drill bit to engage the drill bit with the subterranean formation, which may be referred to as applying weight to the drill bit. The force is usually applied by lowering the drill string to allow a portion of the weight of the drill string to be applied to the drill bit. However, for deep wellbores and/or deviated or horizontal sections, the drill string may experience drag forces due to contact with the wellbore walls. This make applying weight to the drill bit by simply lowering the drill string difficult and unreliable. One solution involves the use of a piston tractor system comprising two pistons to apply a force to the drill bit based on hydraulic pressure. However, even this system may become unreliable in the absence of a surface to provide a seal with the pistons. For example, leak paths such as lateral bore holes and/or porous formations may result in a loss of pressure across the pistons, and therefore, a loss of weight on the drill bit.

Disclosed herein is a pipe in pipe piston thrust system having pull and push through coupling designs for use with a wellbore tubular that may be used to bypass various leak paths and/or maintain force on a drill bit or tool within the wellbore. The pipe in pipe piston thrust system described herein may be coupled to a wellbore tubular through the use of tubular string, thereby coupling the pipe in pipe piston thrust system to the wellbore tubular. Drilling with reel-well like systems requires the weight applied to the bit to be primarily controlled by pressure behind a piston in a casing or liner section behind the interval being drilled. If this back up pressure is lost due to the piston traversing a lateral branch or path in the wellbore, a perforated zone, a screen lined zone or a slotted liner/casing zone, pressure fluid can be lost into the formation and the pumps on the surface may not be able to pump hard enough to maintain the desired weight on a bit as the fluid drains into a formation from the bore hole where the piston is located. These types of fluid loss pathways may be referred to as leak paths, and in some contents, lateral leak paths. In some cases, a lateral path may be sealed to fluid flow, but the presence of the lateral path may be sufficient to disrupt the seal formed between a piston and the wellbore. Once the piston is past the sealed lateral path, the seal may be reformed and any fluid in communication with the sealed pathway may be used to apply pressure to the piston. These types of lateral paths may be referred to as lateral breaks.

A pipe in pipe piston thrust system may be implemented to overcome these obstacles. The pipe in pipe piston thrust system comprises a plurality of piston assemblies which selectively sealingly engage a wellbore. A plurality of annuli can be formed between a wellbore tubular, the wellbore wall and/or a casing inner surface, and the plurality of piston assemblies. As a result, the plurality of annuli can be disposed longitudinally above, below, and/or between the plurality of piston assemblies, though in some embodiments described herein, a plurality of radial annuli may also be present. A by-pass may be disposed between the plurality of annuli, where the by-pass allows for the selective communication of a fluid between the plurality of annuli. This system allows the user to effortlessly drive a drill bit through subterranean formations avoiding unnecessary hassle and steps when the wellbore has a lateral leak path or a lateral break. The pipe in pipe piston thrust system further comprises a pump which transfers fluid into the wellbore. Additionally, the pipe in pipe piston thrust system may comprise a selectively fixed attachment of the plurality of piston assemblies to a tubular string.

In order to drive a drill bit through a wellbore when there is a leak path, a first piston assembly may be disposed within and sealingly engaged with the wellbore. A by-pass in the first piston assembly may be disposed in the closed position. To operate the pipe in pipe piston thrust system, pressure may be increased across the first piston assembly. This may be carried out by pumping fluid on top of the first piston assembly. Once pressure is increased across the first piston assembly, the first piston assembly may be axially displaced in the downstream direction through the wellbore. After the first piston assembly is axially displaced through the wellbore, a second piston assembly may be selectively sealingly engaged with the wellbore. Similar to the first piston assembly, pressure may be increased across the second piston assembly by pumping fluid on top of the second piston assembly. The by-pass of the second piston assembly may then by placed in the open position so that fluid may communicate with the annulus between the first and second piston assemblies applying pressure on the first piston assembly in order to apply weight as close as possible to the drill bit. The annulus comprises the distance, for example, between the top of the first piston assembly and the bottom of the second piston assembly. The annulus also comprises the distance between the outer wall of the tubular string and the wall of the wellbore or the wellbore casing. The first and the second piston assemblies then may be axially displaced in the downstream direction through the wellbore so that the first piston assembly reaches a leak path. The leak path allows fluid to leak through the wellbore wall and into the subterranean and thus pressure is lost across the first piston assembly. At this point, the piston assemblies may not be pressured to drive the drill bit through the wellbore. In order to apply pressure again, the by-pass on the first piston assembly may be disposed into the open position. Furthermore, the second piston assembly may be disposed to the closed position. This creates a differential pressure across the second piston assembly allowing for the weight to be applied again to drive the drill bit.

In order to drive a drill bit through a wellbore when there is a lateral break, a first piston assembly may be disposed within and selectively sealingly engaged with the wellbore. A by-pass in the first piston assembly, may be disposed in the closed position. To operate the pipe in pipe piston thrust system pressure may be increased across the first piston assembly. This may be carried out by pumping fluid on top of the first piston assembly. Once pressure is increased across the first piston assembly, the first piston assembly may be axially displaced in the downstream direction through the wellbore. After the first piston assembly is axially displaced through the wellbore, a second piston assembly may be selectively sealingly engaged with the wellbore. Similar to the first piston assembly, pressure may be increased across the second piston assembly by pumping fluid on top of the second piston assembly. The by-pass of the second piston assembly may then by placed in the open position so that fluid may communicate with the annulus between the first and second piston assemblies applying pressure on the first piston assembly in order to apply weight as close as possible to the drill bit. The first and the second piston assemblies then may be axially displaced in the downstream direction through the wellbore so that the first piston assembly reaches a lateral break. The lateral break breaks the seal between the first piston assembly and the wellbore so that pressure is lost across the first piston assembly. With the lateral break, fluid does not leak through the walls of the wellbore and into the subterranean formations. At this point the piston assemblies are not pressured to drive the drill bit through the wellbore. In order for the piston to cross the lateral break, the by-pass of the first piston assembly may be placed in the open position. The by-pass of the second piston assembly may be placed in the closed position to create a differential pressure across the second piston assembly allowing for the weight to be applied again to drive the drill bit. The first and the second piston assemblies may then be axially displaced in the downstream direction through the wellbore so that first piston assembly passes the lateral break and reseals with the wellbore. At this point, the by-pass of the first piston assembly may be place back in the closed position and the by-pass of the second piston assembly may be placed in the open position so that fluid may again communicate to the first piston assembly applying pressure on the first piston assembly to drive the drill bit.

Upon encountering a reduced diameter within the wellbore, the selectively fixed attachment of the plurality of piston assemblies may be selectively released from the tubular string. The piston assemblies may then stack within the wellbore (e.g., on a shoulder formed by the reduced diameter). In order to maintain at least two piston assemblies in the wellbore, multiple piston assemblies may be added to the tubular string as it is lowered in the wellbore. Any extra piston assemblies may serve as back-ups or redundant systems for use in the event that a piston assembly fails and/or when a piston assembly is selectively released from the tubular string within the wellbore. When the tubular string is removed from the wellbore, the piston assemblies that have been released may be selectively reengaged as the tubular string is withdrawn from the wellbore, thus providing redundant piston assemblies that can be attached within the wellbore when the tubular string is conveyed out of the wellbore.

The pipe in pipe piston thrust system provides the opportunity for several advantages. The pipe in pipe piston thrust system allows pressure on a drill bit even in the presence of leak paths and lateral breaks. Previous drilling assemblies may have lost pressure on the drill bit when encountering leak paths or lateral breaks. Additionally, the pipe in pipe piston thrust system allows for continued drilling beyond the leak path or lateral break by traversing the leak path or lateral break. Previous drilling assemblies may not have been able to traverse leak paths or lateral breaks because they were not able to retain pressure on the drill bit beyond the leak path or lateral break. Finally, the pipe in pipe piston thrust system can be easily automated for fast reactions to drops in pressure on drill bits.

Referring to FIG. 1A, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a pipe in pipe piston thrust system 10 may be lowered into the subterranean formation 102 for a variety of workover or treatment procedures throughout the life of the wellbore. The embodiment shown in FIG. 1A illustrates the wellbore tubular 120 in the form of a casing string being lowered into the subterranean formation 102. It should be understood that the wellbore tubular 120 comprising a pipe in pipe piston thrust system 10 is equally applicable to any type of wellbore tubular being inserted into a wellbore, including as non-limiting examples drill pipe, production tubing, rod strings, and coiled tubing. The pipe in pipe piston thrust system 10 may also be used to centralize various subs and workover tools. In the embodiment shown in FIG. 1A, the wellbore tubular 120 comprising the pipe in pipe piston thrust system 10 is conveyed into the subterranean formation 102 in a conventional manner and may subsequently be secured within the wellbore 114 by filling an annulus 112 between the wellbore tubular 120 and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1A refers to a stationary drilling rig 106 for lowering and setting the wellbore tubular 120 comprising the pipe in pipe piston thrust system 10 within a land-based wellbore 114, in alternative embodiments, mobile workover rigs, wellbore servicing units (such as coiled tubing units), and the like may be used to lower the wellbore tubular 120 comprising the pipe in pipe piston thrust system 10 into a wellbore. It should be understood that a wellbore tubular 120 comprising the pipe in pipe piston thrust system 10 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a pipe in pipe piston thrust system 10 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section above the underreamed section. Thus, a wellbore tubular passing down through the wellbore may pass through a smaller diameter passage followed by a larger diameter passage.

The term "casing" is used herein to indicate a protective lining for a wellbore. Casing can serve to prevent collapse of a wellbore, to provide pressure isolation, etc. Casing can include tubulars known to those skilled in the art as casing, liner or tubing. Casing can be segmented or continuous, metal or nonmetal, and can be preformed or formed in situ. Any type of tubular may be used, in keeping with the principles of this disclosure.

Figure 1B:
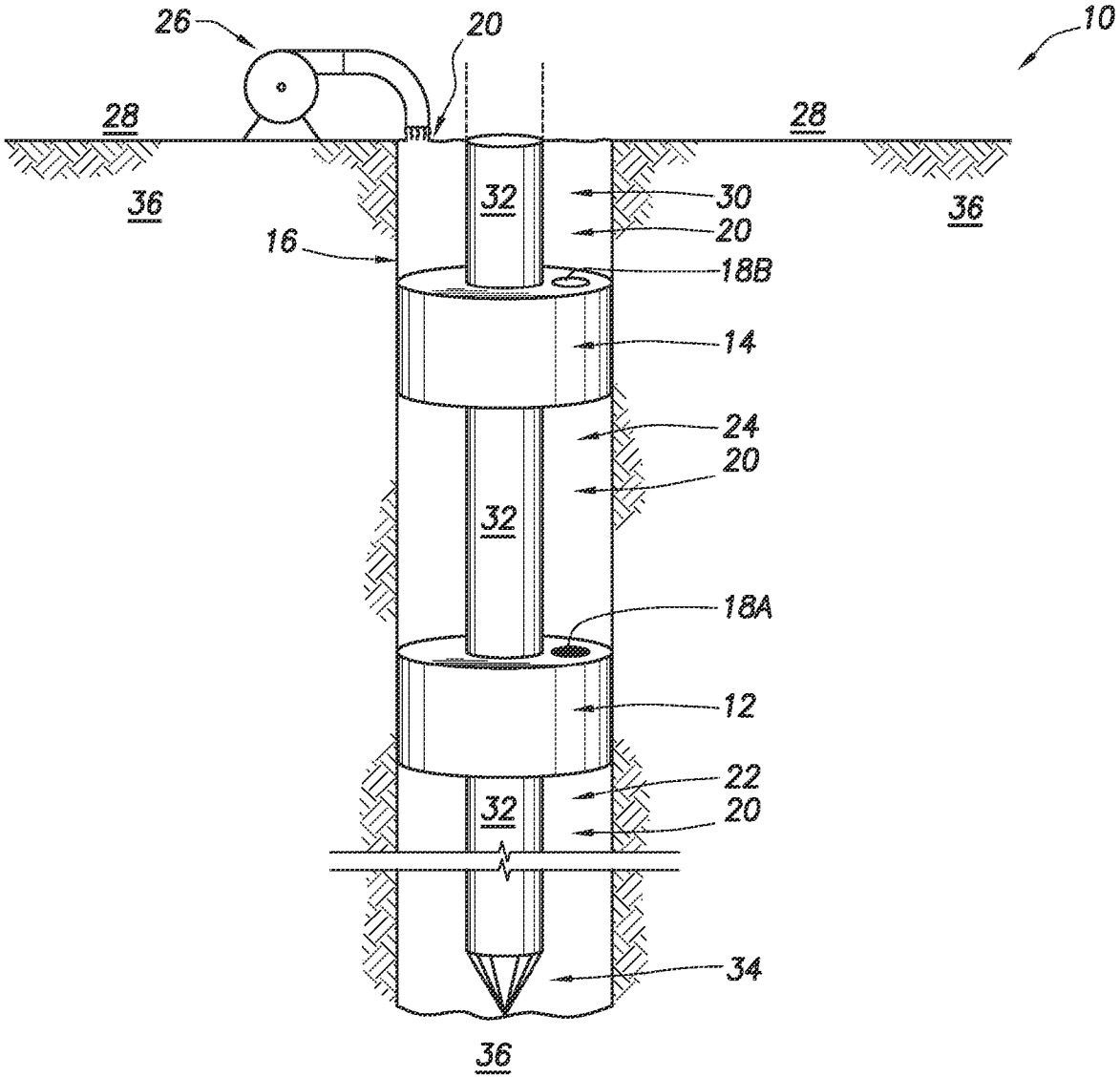
FIG. 1B is a schematic cut-away view of an embodiment of a pipe in pipe piston thrust system.

Turning to FIG. 1B, an embodiment of the pipe in pipe piston thrust system 10 depicts a first piston assembly 12 and a second piston assembly 14 selectively sealingly engaging a wellbore 16. The first piston assembly 12 and the second piston assembly 14 may also slidingly sealingly engage the wellbore 16. In this embodiment, the pipe in pipe piston thrust system 10 could be positioned in an uncased, open hole section of the wellbore 16 (e.g., the section of the wellbore being drilled in FIG. 1B). In an embodiment, the pipe in pipe piston thrust system 10 can be positioned in a cased section of the wellbore 16 lined with a casing and cement so that the first piston assembly 12 and the second piston assembly 14 may selectively sealingly engage the cased section of the wellbore 16. A first by-pass 18A disposed on the first piston assembly 12 allows for the selective communication of a fluid 20 between the first annulus 22 disposed downstream of the first piston assembly 12 and a second annulus 24 disposed between the second piston assembly 14 and the first piston assembly 12. Each by-pass, such as by-passes 18A and 18B, comprise one or more selectively actuatable flow paths to permit fluid communication between annuli. The first annulus 22 and the second annulus 24 may be formed between the tubular string 32 and the wellbore/casing wall. A pump 26 disposed on the surface 28 transfers the fluid 20 into the wellbore 16 and into a third annulus 30 disposed between the surface 28 and the second piston assembly 14. The third annulus 30 may be formed between the tubular string 32 and the wellbore/casing wall. In an embodiment the pump 26 may be disposed on another surface location such as, a rig at the earth's surface, a subsea facility, or a floating rig. In FIG. 1B, the pump 26 previously pumped fluid 20 into the first annulus 22 and the second annulus 24 before the second piston assembly 14 was selectively sealingly engaged in the wellbore 16 so that fluid 20 filled the first annulus 22 and the second annulus 24. A second by-pass 18B may be disposed on the second piston assembly 14 allowing for selective communication of the fluid 20 between the third annulus 30 and the second annulus 24. A tubular string 32 may be disposed axially in the wellbore 16. A drill bit 34 may be located at the distal end of the tubular string 32 in the wellbore 16. In an embodiment, the first piston assembly 12 and the second piston assembly 14 fixedly sealingly engage the tubular string 32.

In an embodiment, the first piston assembly 12 and the second piston assembly 14 selectively sealingly engage the tubular string 32 and axially reciprocate along the tubular string 32. A coupling mechanism may be used to selectively sealingly engage the first piston assembly 12 and the second piston assembly 14 with the tubular string 32. The coupling mechanism may be operated in response to a sensed drilling operation. The coupling mechanism may comprise a latching and de-latching system. In an embodiment, the de-latching system would be activated by a shear force across the piston such that if the shear force across the piston from the diameter change in the hole exceeds a desired threshold the piston unlatches or shears a shear pin which was holding the piston to the outer pipe in its relative position. This embodiment works well if there is no further anticipated use for the piston. In an embodiment the coupling mechanism may have fixed latch points where re-coupling may occur. In an embodiment, it may also be desirable to have a permanent decoupling of the piston from the outer pipe. The coupling mechanism may allow the first piston assembly 12 and the second piston assembly 14 to selectively sealingly engage anywhere axially along the tubular string 32, and/or the coupling mechanism may allow the first piston assembly 12 and the second piston assembly 14 to selectively sealingly engage at pre-determined points along the axis of the tubular string 32. In an embodiment, the coupling system may receive a signal from a control system 56 depicted in FIG. 1D to selectively sealingly engage the first piston assembly 12 and/or the second piston assembly 14 with the tubular string 32.

When the first piston assembly 12 and the second piston assembly 14 sealingly engage the tubular string 32 and the second by-pass 18B is closed, fluid 20 pumped from pump 26 creates a pressure differential across the second piston assembly 14 and, for example, drives drill bit 34 and the tubular string 32 through the subterranean formation 36. The pipe in pipe piston thrust system 10 may be used to advance the tubular string 32 for a variety of other reasons. In an embodiment, it may be advantageous to open the second by-pass 18B to allow for fluid communication between the second annulus 24 and the third annulus 30 so that pump 26 can apply a pressure differential to the first piston assembly 12 to drive the drill bit 34 and the tubular string 32 with a force applied closer to the drill bit 34.

In an embodiment, the tubular string 32 may be advanced through the wellbore 16 in order to continue to drill the wellbore 16. In other examples, the tubular string 32 may be displaced in order to expand the casing or another casing, to install casing, to convey completion equipment or other types of equipment through the wellbore 16, etc. The tubular string 32 may be displaced through the wellbore 16 for any purpose, in keeping with the principles of this disclosure.

Figure 1C:
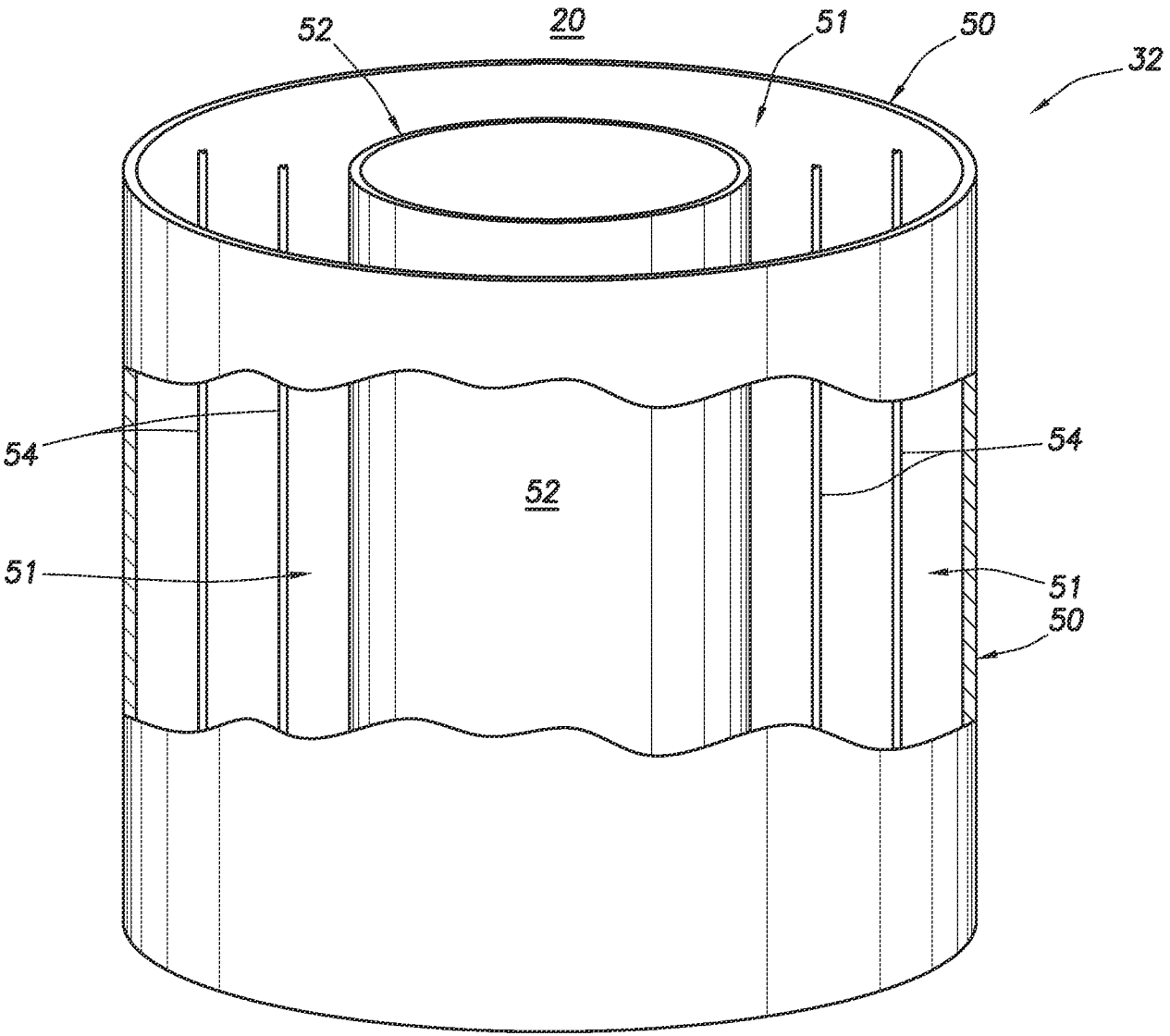
FIG. 1C is a schematic cut-away view of an embodiment of a tubular string.

In an embodiment, the tubular string 32 may comprise various components. As depicted in FIG. 1C, the tubular string 32 may include outer and inner tubular elements 50, 52 that form walls for a tubular string annulus 51. In an embodiment, various lines 54 may extend within the tubular string annulus 51 to transmit signals. The line may comprise electrical and/or hydraulic lines for transmitting power and/or control signals. For example, the lines 54 may be used to transmit power to various components within the tubular string 32 and the piston assemblies, through a tubular string annulus 51, such as by-pass 18A and by-pass 18B depicted in FIG. 1D. In an embodiment, power and/or control signals may be transmitted using an annular tubular configuration. For example, power and/or control signals may be transmitted through outer tubular element 50 and/or inner tubular element 52 utilizing outer tubular element 50 and/or inner tubular element 52 as conductors. In an embodiment, an electrical insulator (not shown) may be disposed between the outer tubular element 50 and inner tubular element 52 to electrically insulate the outer tubular element 50 from the inner tubular element 52 along its length. In this embodiment, physical electrical lines 54 may not be necessary to transmit control signals between various sensors within the pipe in pipe piston thrust system 10 and the control system 56 depicted in FIG. 1D. An example of the inner and outer pipe system for transferring signals through a drill pipe system can be found in U.S. Application Publication No. 2012/0125686 A1, titled "Method and System for Transferring Signals Through a Drill Pipe System" and published on May 24, 2012 to Hogseth et al., which is incorporated herein by reference in its entirety. In an embodiment, power and/or control signals may be transmitted using any combination of lines and the annular tubular elements. For clarity of illustration and description, additional equipment which may be used in the tubular string 32 is not depicted in FIG. 1B. For example, the tubular string 32 could include a drilling motor (also known as a mud motor, e.g., a Moineau-type motor or a turbine) for rotating the drill bit 34 depicted in FIG. 1A, rotary steerable tools, jars, centralizers, reamers, stabilizers, measurement-while-drilling (MWD), pressure-while-drilling (PWD) or logging-while-drilling (LWD).

Figure 1D:
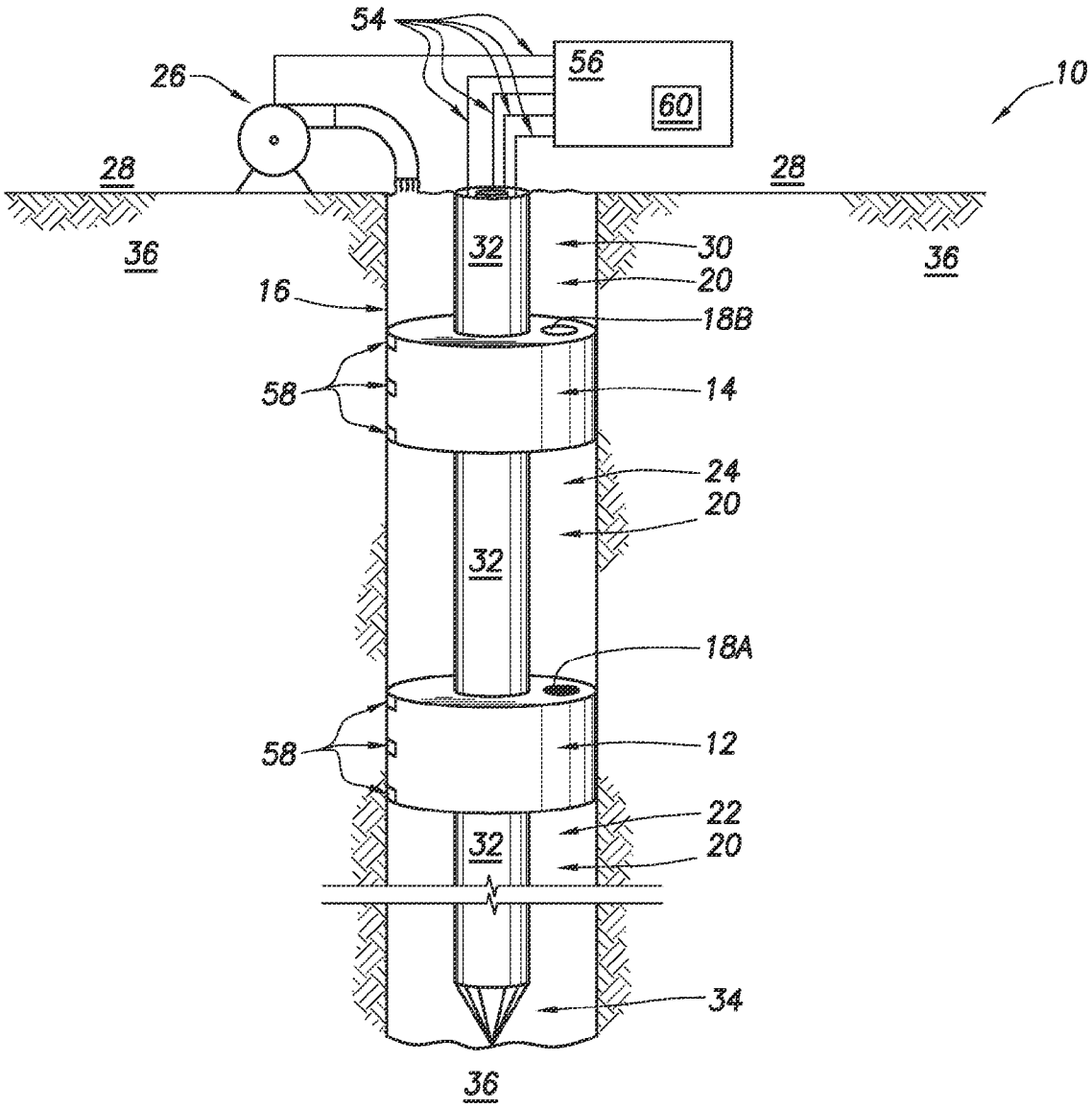
FIG. 1D is a schematic cut-away view of an embodiment of a pipe in pipe piston thrust system.

In an embodiment, a control system 56 may be used to control the operation of the pipe in pipe piston thrust system 10. As illustrated in FIG. 1D, the lines 54 may extend from the surface 28 where a control system 56 is coupled to the pipe in pipe piston thrust system 10. In an embodiment, the control system 56 or one or more portions of the control system 56, may be disposed beneath the surface 28. In an embodiment, the control system may not require lines 54. The control system 56 (e.g., with the wellbore 16) comprises a plurality of sensors 58. The plurality of sensors 58 may be disposed within the wellbore 16 to measure, in an embodiment, the differential pressure across the first piston assembly 12 and/or the second piston assembly 14. In an embodiment, the sensors 58 may detected when the first piston assembly 12 and/or the second piston assembly 14 sealingly engage the wellbore 16.

In an embodiment, the sensors 58 may detect how much weight is being applied to the drill bit 34 depicted in FIG. 1B and/or the flow of fluid 20 from the pump 26.

The control system 56 may also control the selective sealing engagement of the first piston assembly 12 and the second piston assembly 14 to the tubular string 32 and/or the wellbore 16. The control system 56 may include a processor 60 which responds to signals sent from the sensors 58 by selectively opening and closing at least one by-pass. The processor 60 may also provide data to an operator illustrating the conditions such as pressure, temperature, depth, etc. in the wellbore 16 so that the operator may selectively open and close a by-pass manually. Additionally, the processor 60 may send a signal to the pump 26 to increase or decrease the fluid flow through the wellbore 16. By opening and/or closing by-passes 18A and 18B and varying the fluid flow through the pump 26 the desired weight may be maintained on the drill bit 34. Other drilling operating parameters that may be read and may be controlled by the control system 56 may comprise thrust, tension, torque, bend, vibration, rate of penetration, and/or stick-slip. In an embodiment, the pump 26 may be operated manually and the by-passes 18A and 18B may be operated by a mechanical means such as, in an embodiment, dropping balls or darts of different sizes from the surface 28 into the wellbore 16 to selectively open or close by-passes 18A and 18B.

The pipe in pipe piston thrust system 10 described herein may be used to cross a leak path. As shown in FIGS. 2A, 2B, 2C, and 2D, a method for traversing a leak path comprises a pipe in pipe piston thrust system 10 operating when there is a lateral leak path 80. After the pump 26 pumps fluid 20 into the first annulus 22 of the wellbore 16 where the tubular string 32 and drill bit 34 are disposed. A first piston assembly 12 disposed in the wellbore 16 selectively sealingly engages with the wellbore 16 creating a second annulus 24 between the first piston assembly 12 and the surface 28. In an embodiment, the first piston assembly 12 comprises a by-pass 18A which allows for selective communication of the fluid 20 between the first annulus 22 and the second annulus 24. In an embodiment, the by-pass 18A may not be integrated with the first piston assembly 12 and may be located in a fixed position along the wellbore 16. In an embodiment illustrated in FIG. 2A, the by-pass 18A is closed so that pump 26 may provide fluid pressure on the first piston assembly 12, thereby applying weight to drive the drill bit 34 through the subterranean formation 36. In an embodiment, the by-pass 18A may be open when additional weight is not needed to drive the drill bit 34 through the subterranean formation 36. In an embodiment, the first piston assembly 12 is fixedly attached to the tubular string 32. In an embodiment, the first piston assembly 12 may selectively sealingly engaged with the tubular string 32 so that the first piston assembly 12 may move axially along the tubular string and then sealingly engage the tubular string 32 preventing fluid communication between the first annulus 22 and the second annulus 24. The selectively sealingly engagement of the first piston assembly 12 to the tubular string 32 may be accomplished by the coupling system previously described. The pump 26 may then pump fluid into the second annulus 24 creating pressure on the first piston assembly 12 and applying weight on the drill bit 34.

Figure 2A:
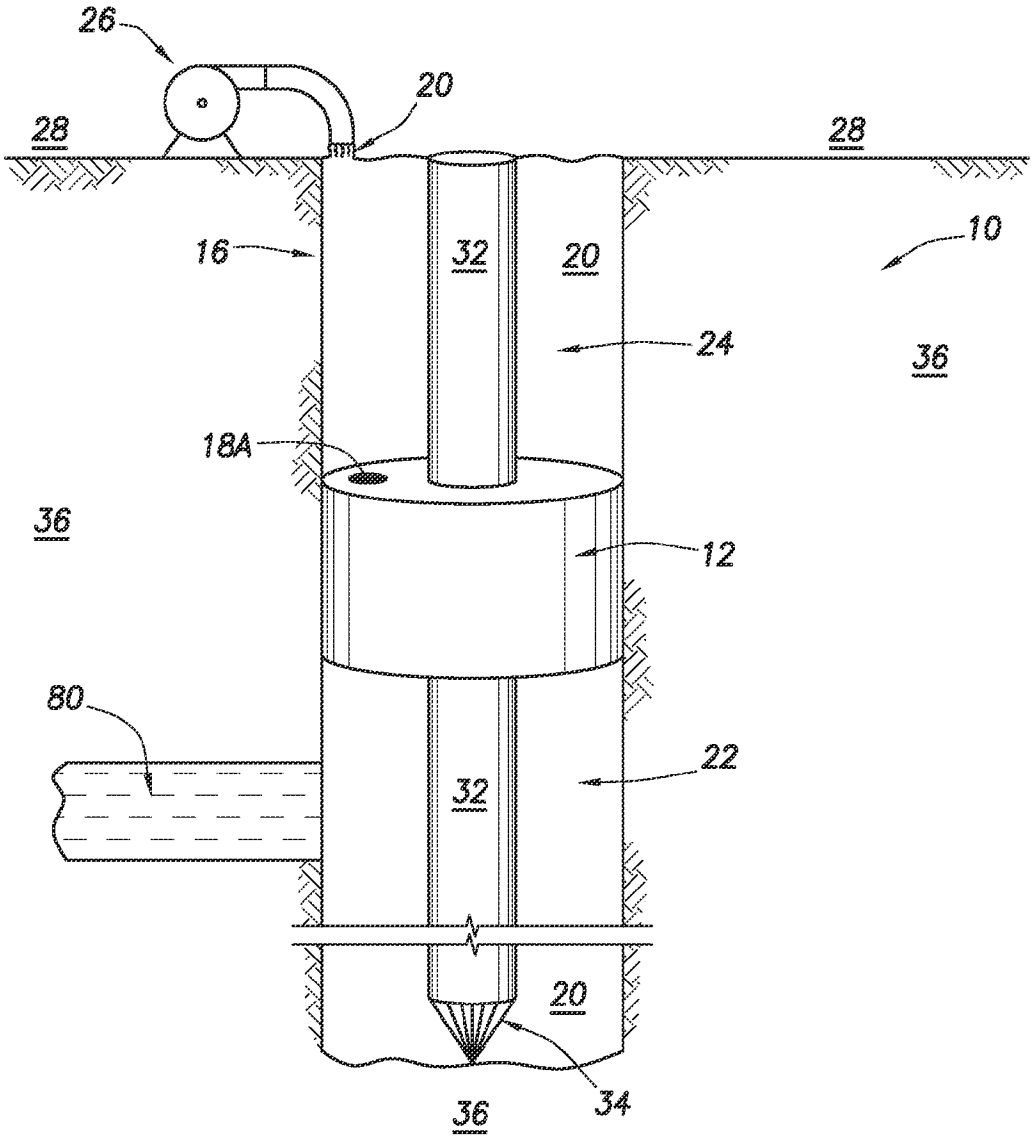
FIGS. 2A-2D are schematic cut-away views of an embodiment of a pipe in pipe piston thrust system.
Figure 2B:
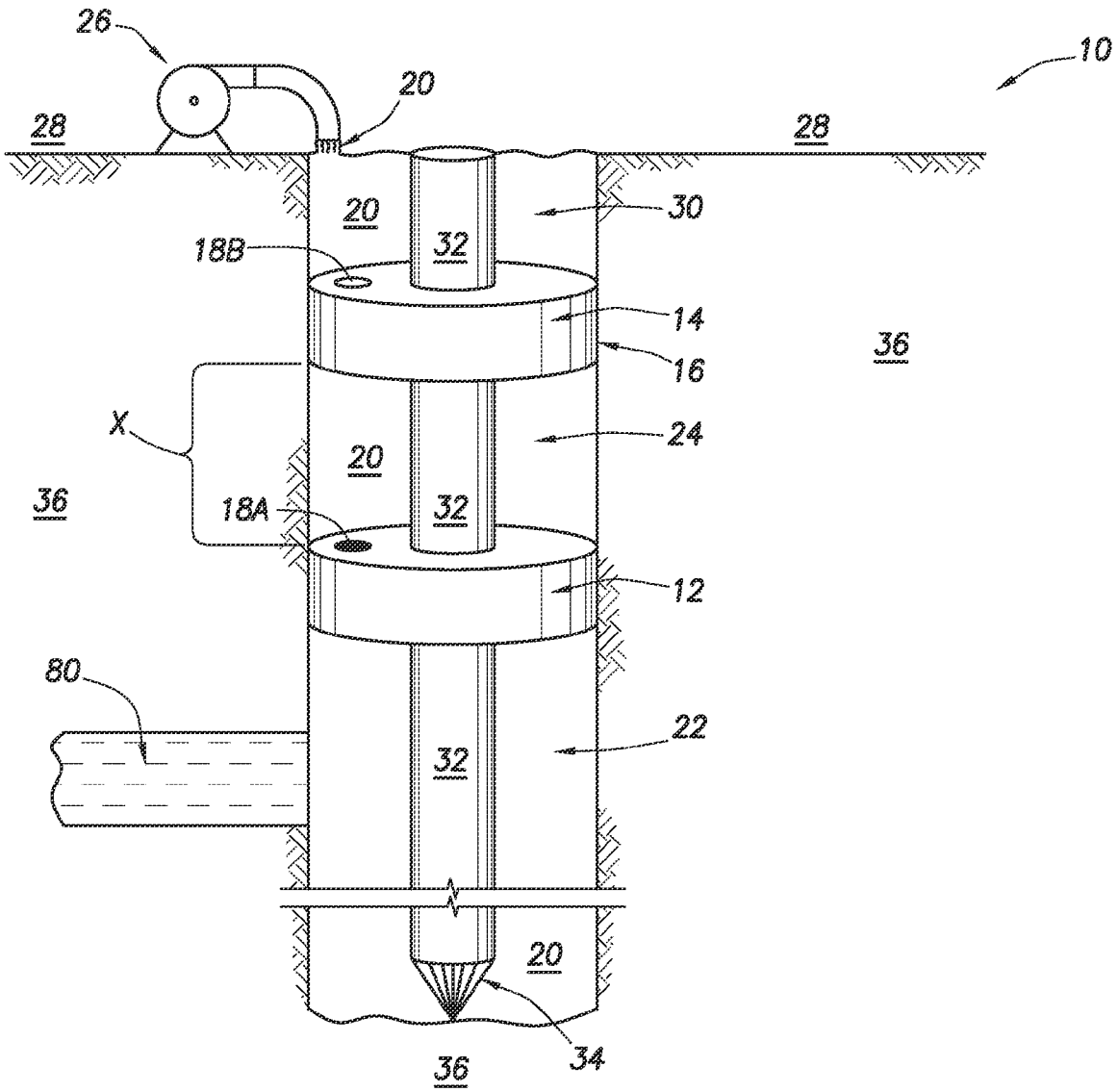

Turning to FIG. 2B, as the drill bit 34 drives deeper through the subterranean formation 36, a second piston assembly 14 is disposed in the wellbore 16, which may selectively sealingly engage with the wellbore 16 to create a third annulus 30 between the second piston assembly 14 and the surface 28. In this embodiment, the second piston assembly 14 may be fixedly attached to the tubular string 32 so that as the drill bit 34 and the first piston assembly 12 move axially through the wellbore 16, so does the second piston assembly 14, and the first piston assembly 12 and the second piston assembly 14 may slidingly sealingly engage the wellbore 16. This also allows for the second annulus 24 to maintain an axial distance X along the wellbore 16. In this embodiment the second piston assembly 14 comprises a by-pass 18B which allows for selective communication of the fluid 20 between the second annulus 24 and the third annulus 30. In an embodiment, the by-pass 18B may not be integrated with the second piston assembly 14 and may be located in a fixed position along the wellbore 16. The by-pass 18B may remain open so that fluid 20 can communicate between the third annulus 30 and the second annulus 24, thereby applying pressure to the first piston assembly 12 to drive the drill bit 34. In an embodiment, the by-pass 18B may remain closed preventing fluid from communicating between the third annulus 30 and the second annulus 24 and thus applying pressure to the second piston assembly 14 to drive the drill bit 34.

Figure 2C:
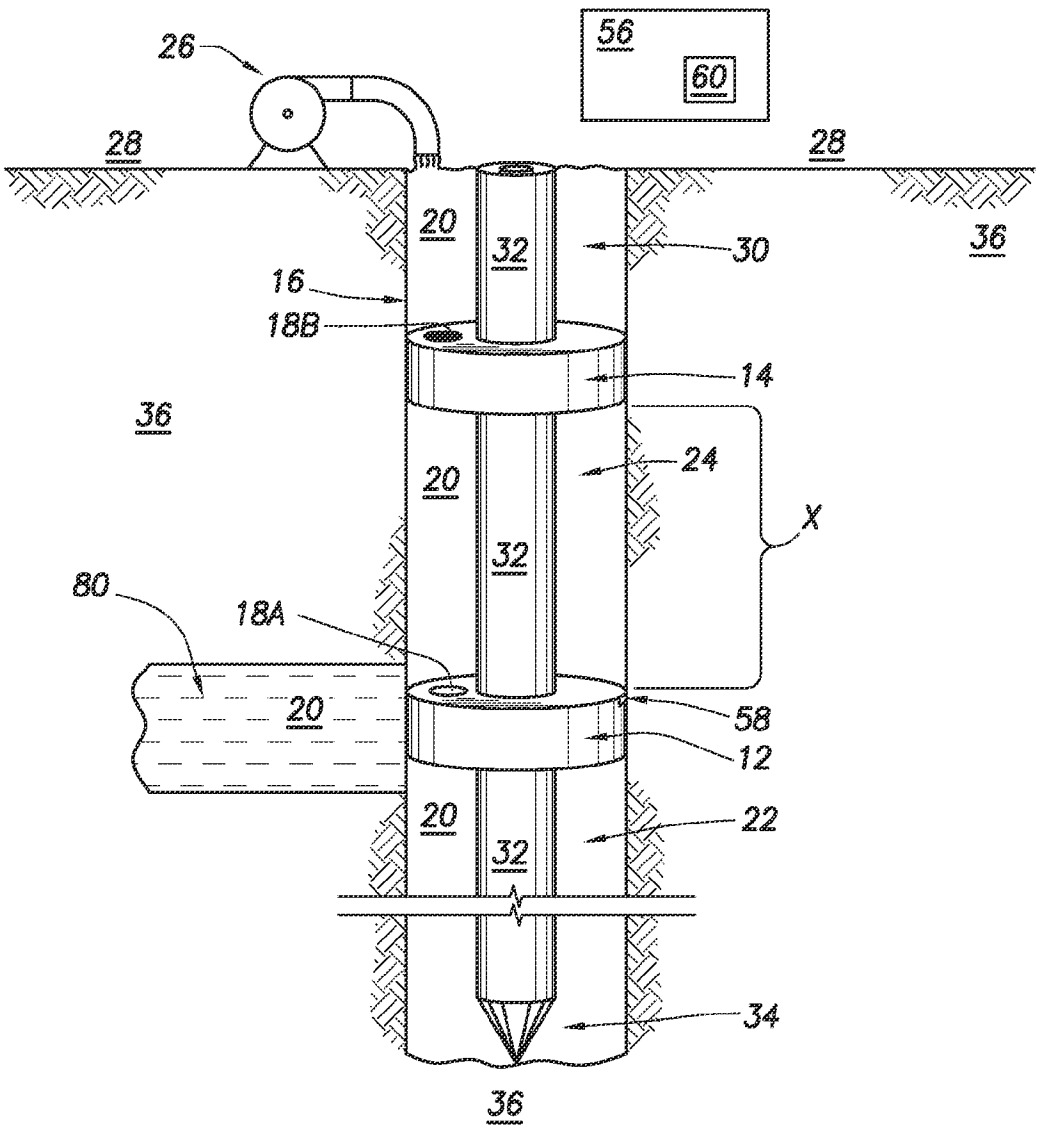

Turning to FIG. 2C, the first piston assembly 12 and the second piston assembly 14 may move axially downstream through the wellbore 16 where the first piston assembly 12 encounters a lateral leak path 80. The distance X between the upstream side of the first piston assembly 12 and the downstream side of the second piston assembly 14 may be maintained. In this scenario, as the fluid 20 permeates through the walls of the wellbore 16, fluid pressure created by the pump 26 can no longer be maintained on the first piston assembly 12 to drive the drill bit 34. A sensor 58 may detect the drop in pressure across the first piston assembly 12 due to the lateral leak path 80 and sends a signal to a processor 60 of a control system 56 or sends a signal to an operator located on the surface 28. In an embodiment, the rate of axial movement, which may slow due to the loss of fluid pressure across the first piston assembly 12 may be used to indicate the presence of a leak path 80. To continue applying weight to the drill bit 34 while pressure is lost across the first piston assembly 12, the by-pass 18A on the first piston assembly 12 is open and the by-pass 18B on the second piston assembly 14 is closed preventing fluid communication between the second annulus 24 and the third annulus 30. The output of the pump 26 may also be adjusted. This configuration allows for pressure to be applied on the second piston assembly 14 so that weight may continue to be applied driving the drill bit 34 through the subterranean formation 36.

Figure 2D:
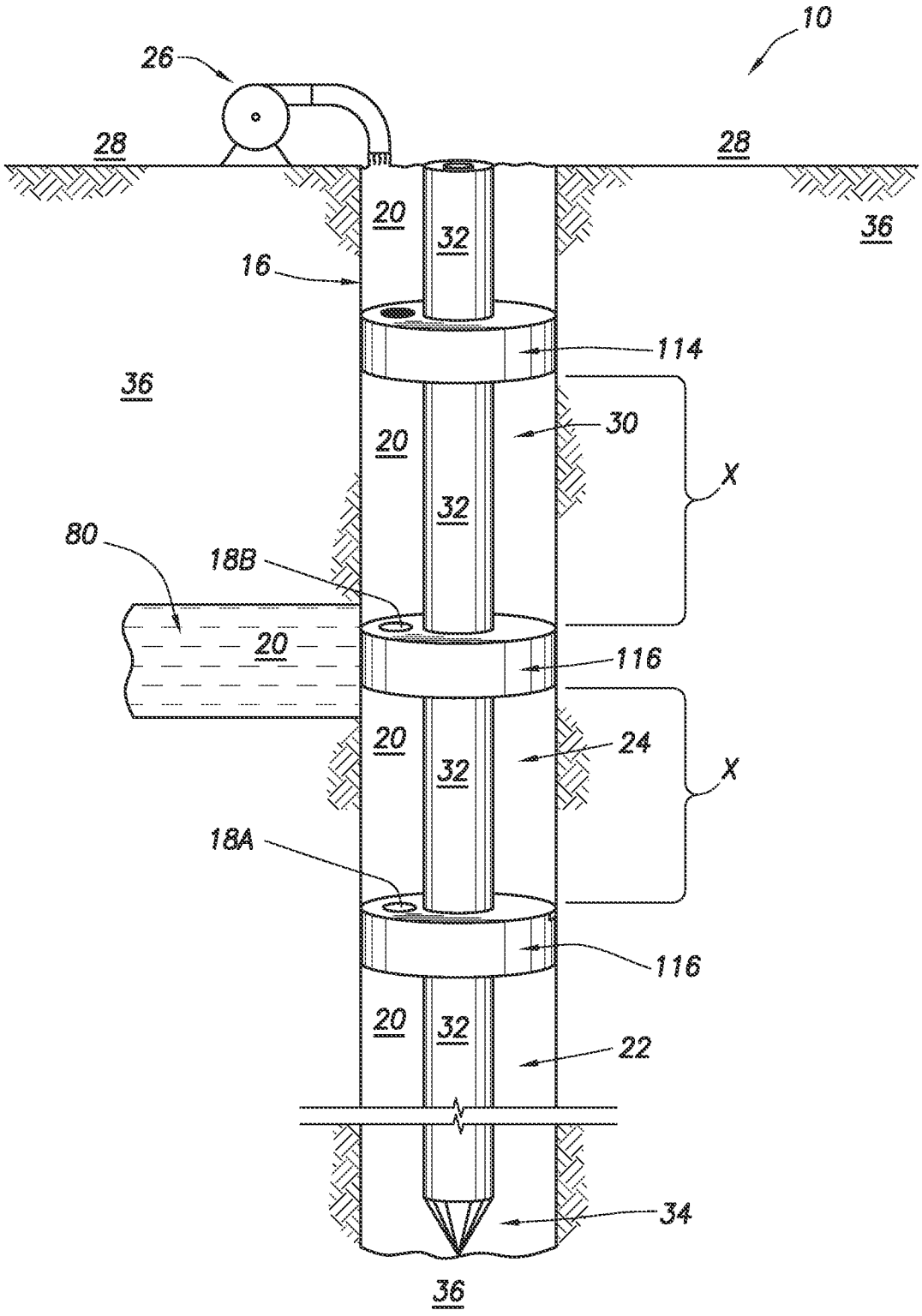

As illustrated in FIG. 2D, one or more subsequent piston assemblies may continue to drive the drill bit 34 through the subterranean formation 36 as each piston assembly 116 moves axially along the wellbore 16 and enters the leak path 80. The steps described with respect to FIGS. 2A-2D may be repeated for each of the one or more subsequent piston assemblies 114.

As shown in FIGS. 3A, 3B, 3C and 3D a method for traversing a lateral break may include using a pipe in pipe piston thrust system 10 operating when there is a lateral break 82. The pump 26 pumps fluid 20 into the first annulus 22 of the wellbore 16 where the tubular string 32 and drill bit 34 are disposed. A first piston assembly 12 is disposed in the wellbore 16 selectively sealingly engages with the wellbore 16 creating a second annulus 24 between the first piston assembly 12 and the surface 28. In an embodiment, the first piston assembly 12 comprises a by-pass 18A that allows for selective communication of the fluid between the first annulus 22 and the second annulus 24. In an embodiment, the by-pass 18A is closed so that pump 26 may provide fluid pressure on the first piston assembly 12, thereby applying weight to drive the drill bit 34 through the subterranean formation 36. In this embodiment, the first piston assembly 12 is fixedly attached to the tubular string 32. A pump 26 then pumps fluid 20 into the second annulus 24 creating pressure on the first piston assembly 12 allowing weight to drive the drill bit 34.

Figure 3A:
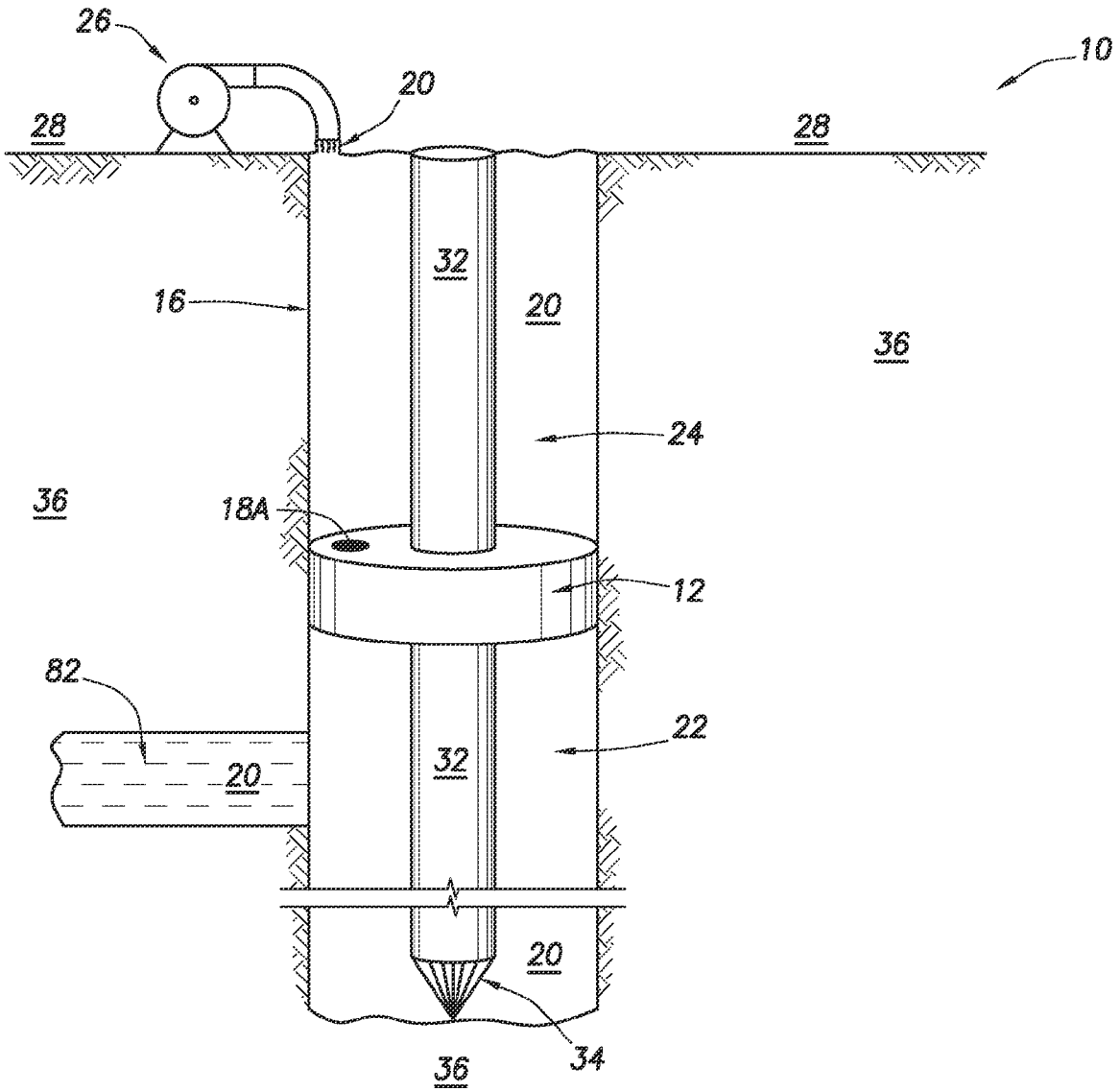
FIGS. 3A-3D are schematic cut-away views of an embodiment of a pipe in pipe piston thrust system.
Figure 3B:
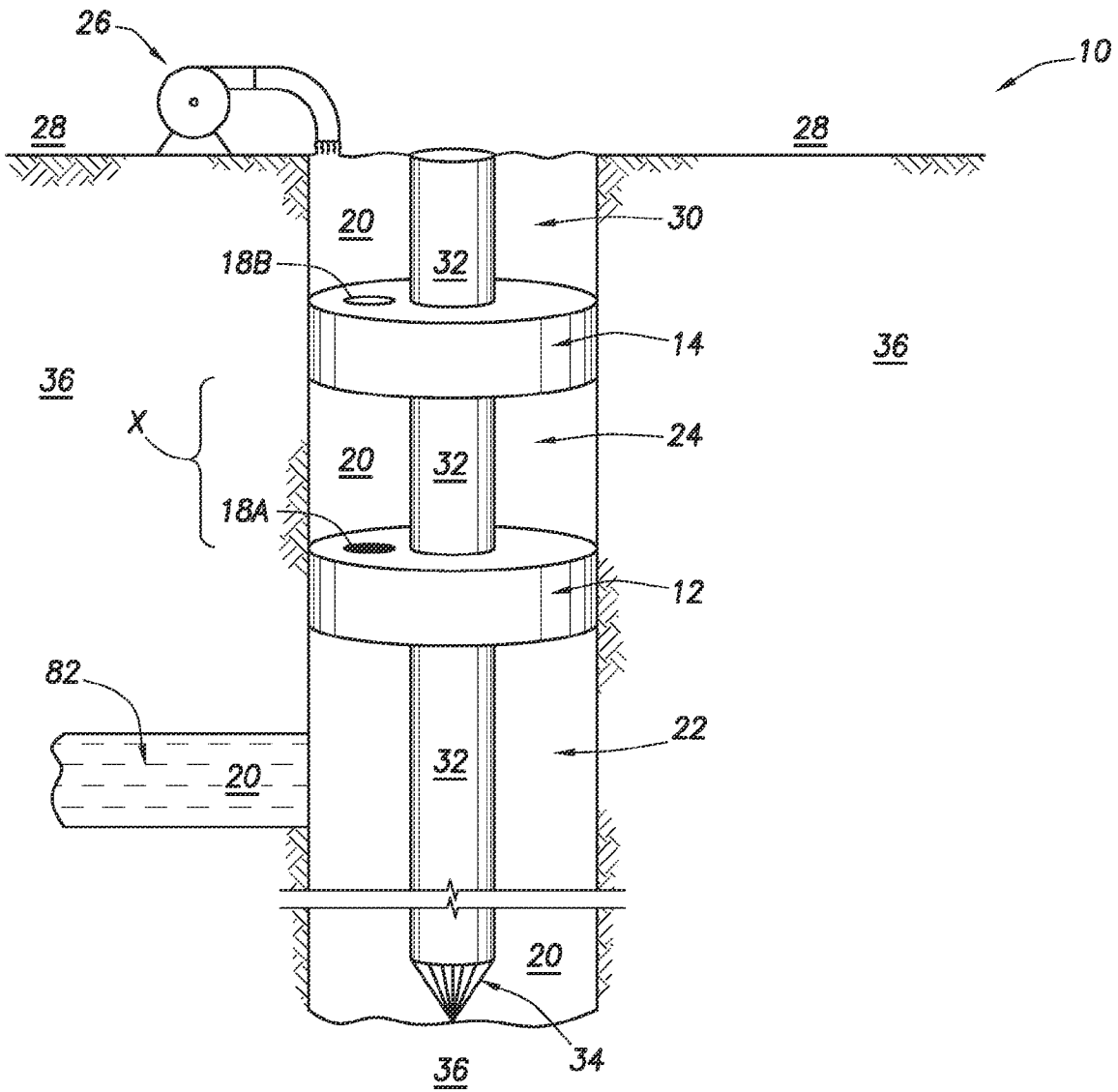

Turning to FIG. 3B, as the drill bit 34 drives deeper through the subterranean formation 36, a second piston assembly 14 may be disposed in the wellbore 16 and selectively sealingly engage with the wellbore 16 creating a third annulus 30 between the second piston assembly 14 and the surface 28. In this embodiment, the second piston assembly 14 is fixedly attached to the tubular string 32 so that as the drill bit 34 and the first piston assembly 12 move axially through the wellbore 16, so does the second piston assembly 14, and the first piston assembly 12 and the second piston assembly 14 may slidingly sealingly engage the wellbore 16. This also allows for the second annulus 24 to maintain an axial distance X along the wellbore 16. In an embodiment, the second piston assembly 14 comprises a by-pass 18B which allows for selective communication of the fluid 20 between the second annulus 24 and the third annulus 30. In an embodiment, the by-pass 18B may not be integrated with the second piston assembly 14 and may be located in a fixed position along the wellbore 16. In this embodiment the by-pass 18B may remain open so that fluid 20 can communicate between the third annulus 30 and the second annulus 24 applying pressure to the first piston assembly 12 to drive the drill bit 34. In other embodiment, the by-pass 18B may remain closed preventing fluid from communicating between the third annulus 30 and the second annulus 24 and thus applying pressure to the second piston assembly 14 to drive the drill bit 34.

Figure 3C:
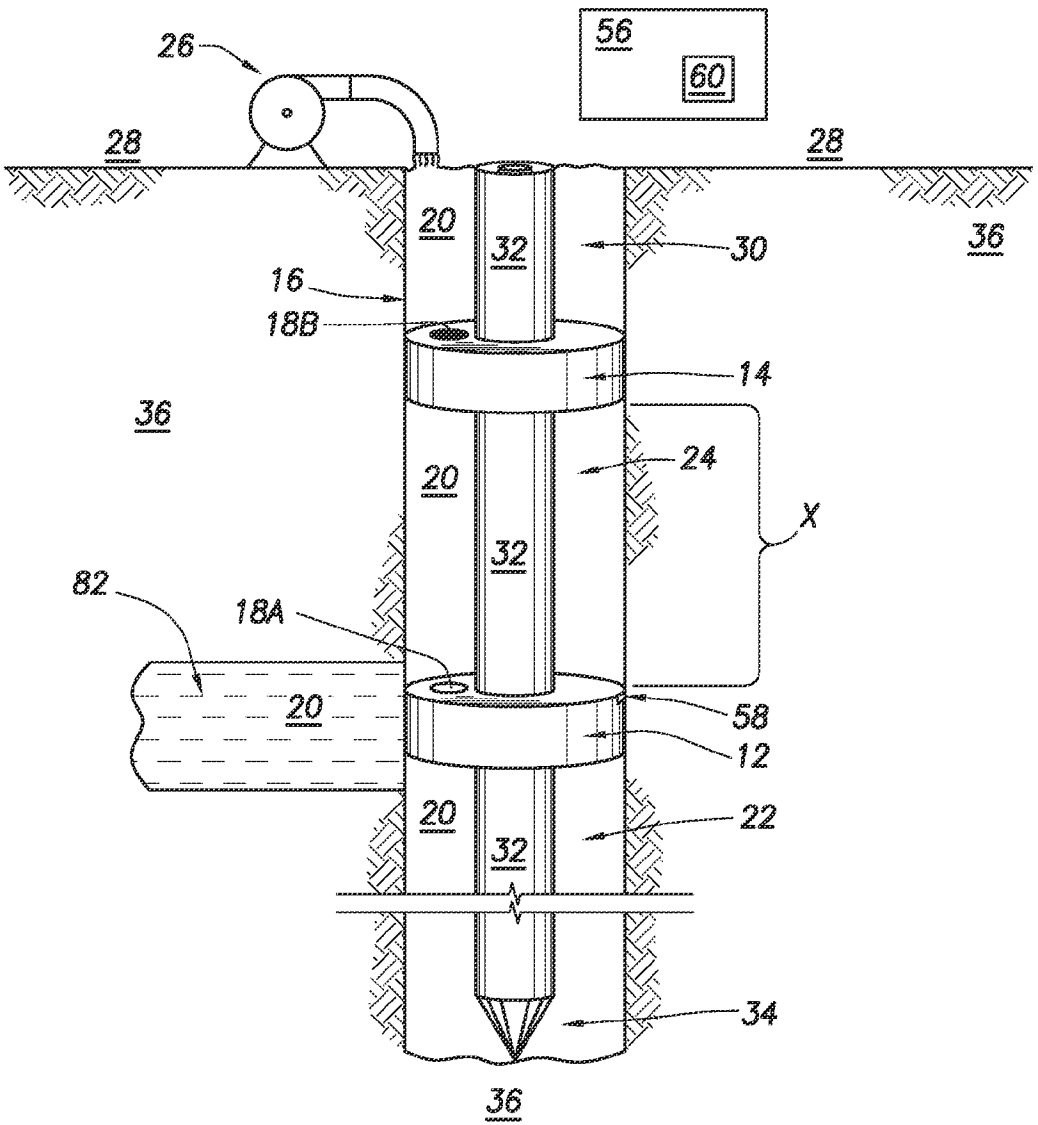

Turning to FIG. 3C, the first piston assembly 12 moving axially down the wellbore 16 may encounter a lateral break 82. The lateral break 82 breaks the sealing engagement between the first piston assembly 12 and wellbore 16, but fluid 20 is not permitted to leak into the subterranean formation 36. However, because the first piston assembly 12 loses its sealing engagement with the wellbore 16, the differential pressure across the first piston assembly 12 may be at least partially lost. The fluid pressure created by the pump 26 may no longer be maintained on the first piston assembly 12 to drive the drill bit 34. A sensor 58 may detect the drop in pressure across the first piston assembly 12 due to the lateral break 82 and sends a signal to a processor 60 of a control system 56 or sends a signal to an operator located on the surface 28. In an embodiment, the rate of axial movement, which may slow due to the loss of fluid pressure across the first piston assembly 12 may be used to indicate the presence of a leak path 80. To continue applying weight to the drill bit 34 while pressure is lost across the first piston assembly 12, the by-pass 18A on the first piston assembly 12 may be opened and the by-pass 18B on the second piston assembly 14 may close, thereby preventing fluid communication between the second annulus 24 and the third annulus 30. The control system 56 may also command the pump to adjust the flow of fluid 20. This configuration allows for pressure to be applied on the second piston assembly 14 so that weight may continue to be applied driving the drill bit 34 through the subterranean formation 36.

Figure 3D:
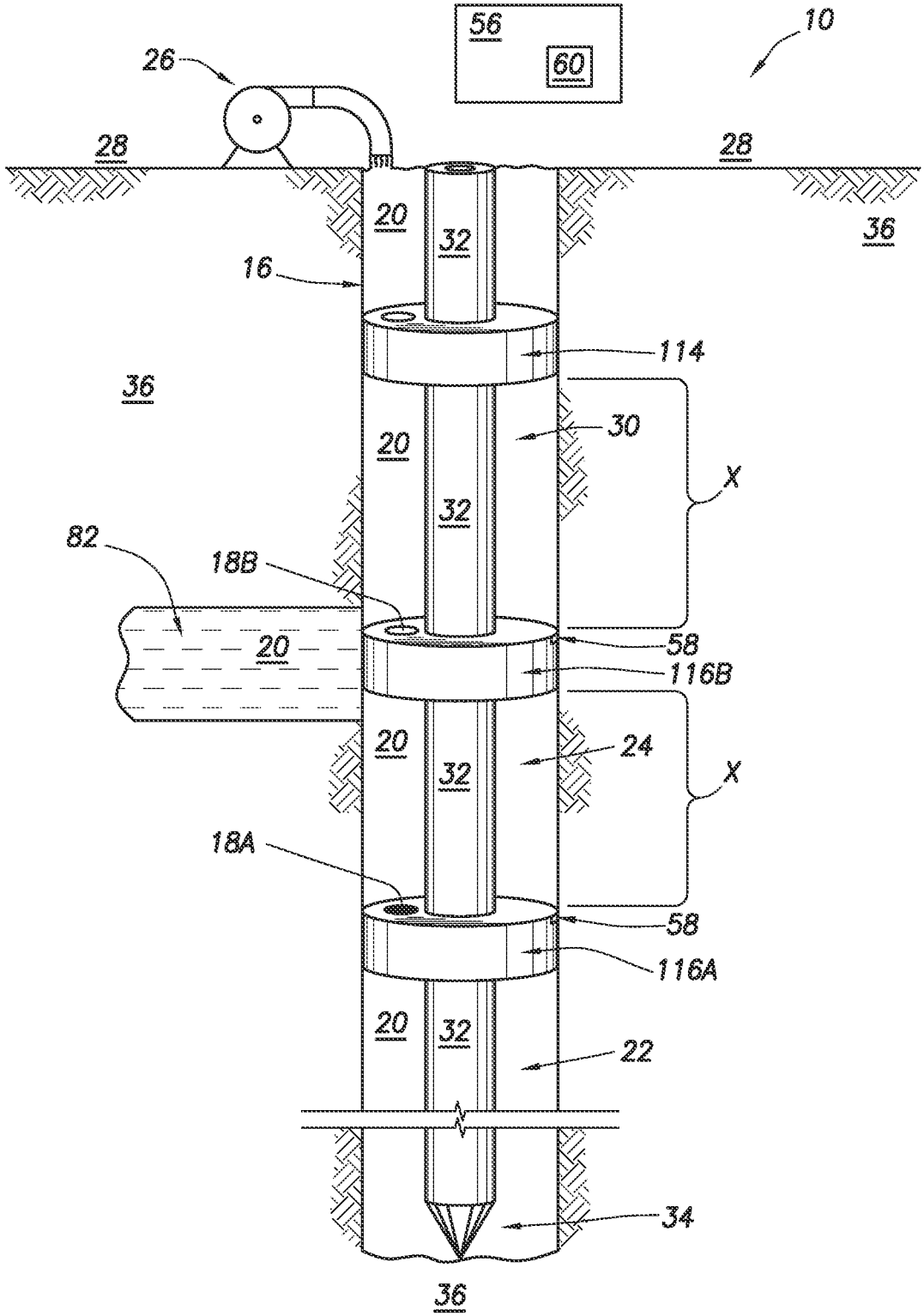

Turning to FIG. 3D, once the first piston assembly 116A moves past the lateral break 82, the first piston assembly 116A sealing engages with the wellbore 16 again. A sensor 58 on the first piston assembly 116A, may detect the sealing engagement with first piston assembly 12 and the wellbore 16 and send a signal to the processor 60 of the control system 56. The processor 60 then commands the by-pass 18A of the first piston assembly 116A to close. The control system 56 may also command the pump 26 to adjust the flow of fluid 20. The control system 56 or an operator at the surface 28 may then command the by-pass 18B of the second pistons assembly 14 to open to apply weight to the first piston assembly 12 which is closest to the drill bit 34.

FIG. 3D depicts additional piston 114. Additional piston 114, may be axially disposed in the wellbore after pistons 116A and 116B have traversed through the wellbore 16. Additional piston 114, may be used to drive the piston if, for example, there is leak path further downstream of pistons 116A and 116B so that additional piston 114 may continue to apply weight to the drill bit 34 when pistons 116A and 116B enter the leak path zone.

Figure 4:
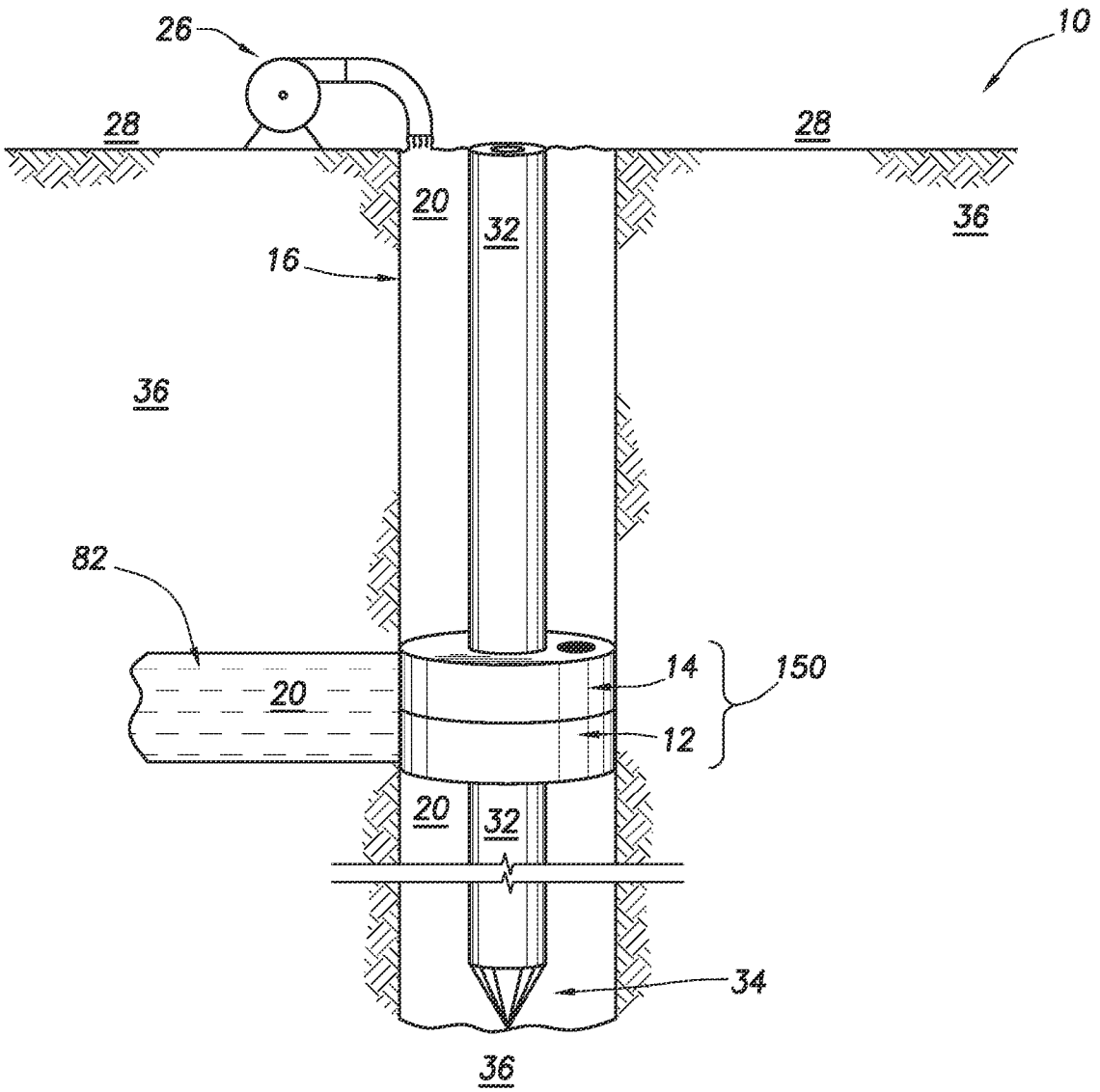
FIGS. 4 and 5 are schematic cut-away views of an embodiment of a pipe in pipe piston thrust system.

Turning to FIG. 4, an embodiment depicts stack 150 comprising the first piston assembly 12 engaged with the second piston assembly 14 wherein the second annulus 24 is closed so that the stack 150 creates a bridge over the lateral break 82 so that a seal is maintained between the stack 150 and the wellbore 16 as the stack 150 crosses the lateral break 82. In an embodiment, the first piston assembly 12 and the second piston assembly 14 comprising the stack 150 is fixedly attached to the tubular string 32. In an embodiment, the first piston assembly 12 and second piston assembly 14 may move axially and independently along the tubular string 32 and engage to form the stack 150 to maintain a sealing engagement with the wellbore 16 across the lateral break 82. The stack 150 may selectively grippingly engage with the tubular string 32. The first piston assembly 12 and the second piston assembly 14 may engage each other using a coupling system (not shown) or in an embodiment with the pressure exerted from the second piston assembly 14 on to the first piston assembly 12. The stack 150 may selectively grippingly engage with the tubular string 32 by a coupling system (not shown) such as latching and de-latching mechanisms where the coupling systems receives a signal to couple or decouple a piston assembly with the tubular string 32. The latching system may allow the piston assembly to couple or decouple anywhere along the axis of the tubular string 32 or there may be pre-selected points along the axis of the tubular string 32 where a piston assembly my couple or decouple with the tubular spring 32.

Figure 5:
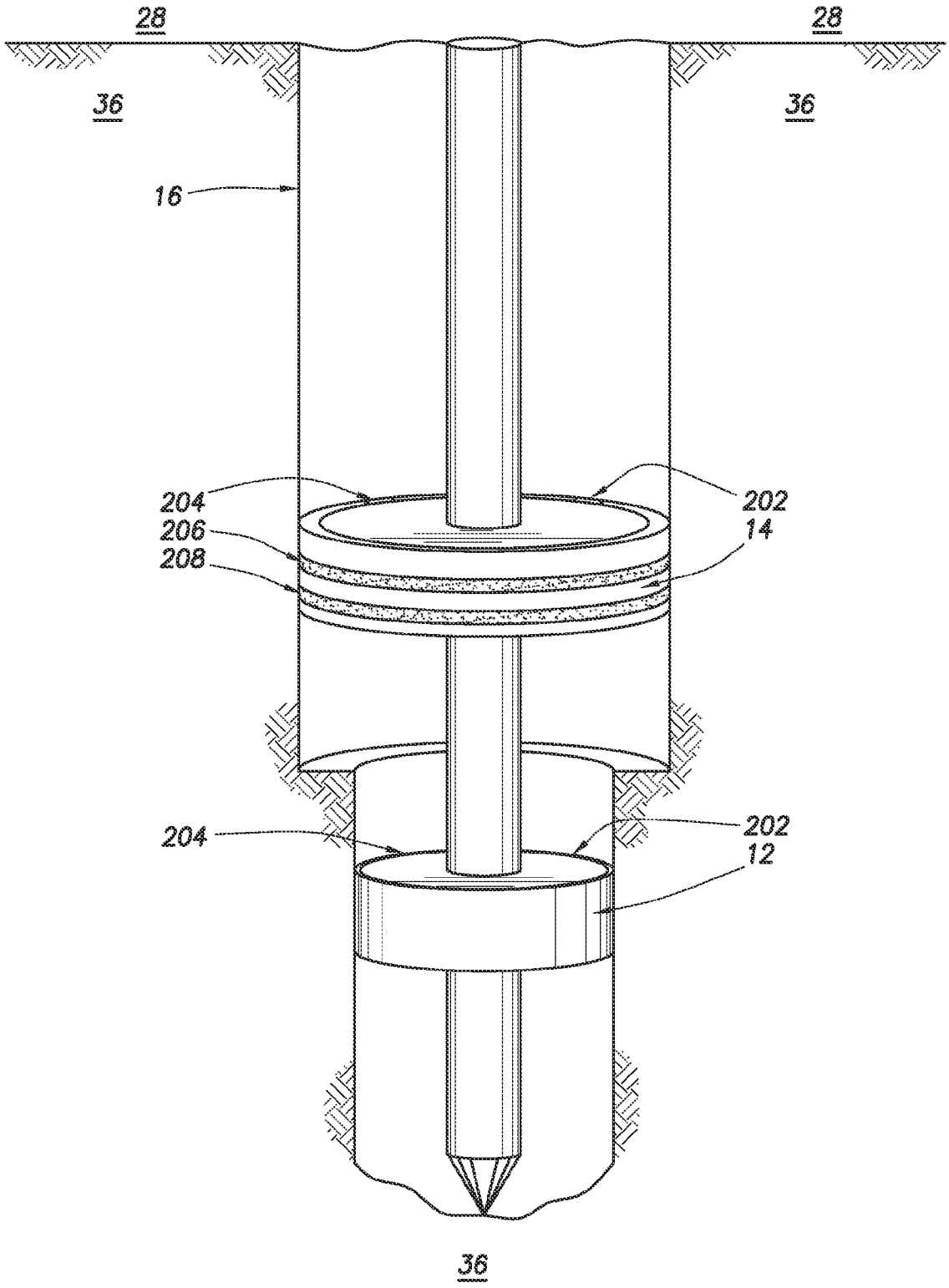

Turning to FIG. 5, an uncased section of the wellbore 16 can have a larger diameter as compared to the cased section of the wellbore 16. In order for a first piston assembly 12 and a second piston assembly 14 to sealingly engage with the wellbore 16, the diameters of the first piston assembly 12 and the second piston assembly 14 can be actuated to increase or reduce in order to accommodate the larger diameter of the wellbore 16. As depicted in FIG. 5, actuators 202 and 204 can be operated to inwardly retract the respective gripping devices 206 and sealing devices 208 so that the diameters of the first piston assembly 12 are less than the diameter of the second piston assembly 14. Actuators 202 and 204 can also be operated expand the respective gripping devices 206 and sealing devices 208 so that the diameters of the piston assemblies may increase. This may be useful when piston assembly moves between cased and uncased wellbores 16. The diameters of the first piston assembly 12 and the second piston assembly 14 may be controlled by the control system 56 of FIG. 1D. Alternatively, the first piston assembly 12 and the second piston assembly 14 may be decoupled from the tubular and left to float at the edge.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method for traversing a leak path comprising:

closing a first by-pass through a first piston assembly, wherein the first piston assembly is disposed in a wellbore;

opening a second by-pass through a second piston assembly to provide fluid communication to the first piston assembly, wherein the second piston assembly is disposed in the wellbore;

axially displacing the first piston assembly and the second piston assembly in a first direction in a wellbore based on the fluid communication with the first piston assembly;

closing the second by-pass through the second piston assembly;

providing a pressure differential across the second piston assembly; and axially displacing the first piston assembly in the first direction past a lateral path based on the pressure differential across the second piston assembly.

2. The method of claim 1, wherein the first piston assembly is downhole from the second piston assembly.

3. The method of claim 1, further comprising:

closing the second by-pass through the second piston assembly;

opening a third by-pass through a third piston assembly to provide fluid communication to the first and second piston assemblies;

axially displacing the first piston assembly, the second piston assembly, and the third piston assembly in the first direction in the wellbore based on the fluid communication with the second piston assembly;

closing the third by-pass through the third piston assembly;

providing a pressure differential across the third piston assembly; and axially displacing the first piston assembly and the second piston assembly in the first direction past a lateral path based on the pressure differential across the third piston assembly.

4. The method of claim 3, wherein the second piston assembly is downhole from the third piston assembly.

5. The method of claim 1, further comprising:

closing a by-pass through at least one previous piston assembly;

opening a by-pass through a subsequent piston assembly to provide fluid communication to at least one of the previous piston assemblies;

axially displacing the subsequent piston assembly and the at least one previous assembly in a first direction in a wellbore based on the fluid communication with the subsequent piston assembly;

closing a by-pass through the subsequent piston assembly;

providing a pressure differential across the subsequent piston assembly; and axially displacing the previous piston assemblies and the subsequent piston assembly in the first direction traversing a lateral path based on the pressure differential across the subsequent piston assembly.

6. The method of claim 5, wherein each the subsequent piston assembly is uphole from the previous piston assemblies.

7. The method of claim 1, wherein the first piston assembly comprises a first piston disposed about a tubular string, and wherein the second piston assembly comprises a second piston disposed about the tubular string.

8. The method of claim 7, wherein the tubular string comprising an electrical pathway configured to conduct electricity and supply electrical power to at least one of the first piston assembly, the second piston assembly, the first by-pass, or the second by-pass.

9. The method of claim 7, further comprising: supplying at least one signal through the tubular string to at least one of the first by-pass or the second by-pass.

10. The method of claim 9, further comprising:

receiving, by a processor, at least one input from at least one sensor; and generating the at least one signal in response to receiving the at least one input.

11. The method of claim 10, further comprising:

receiving at least one drilling operation parameter;

operating a pump in response to the at least one drilling operation parameter; and providing the pressure differential across the second piston assembly in response to operating the pump.

12. A method for traversing a lateral break comprising:

sealingly engaging a first piston assembly with a wellbore;

increasing pressure across the first piston assembly;

displacing the first piston assembly axially within the wellbore in a first direction;

sealingly engaging a second piston assembly with the wellbore to create a first annulus between the first piston assembly and the second piston assembly;

opening a by-pass across the second piston assembly to allow fluid communication to the first annulus;

displacing the first piston assembly and the second piston assembly axially within the wellbore in the first direction while maintaining the first annulus;

opening a by-pass across the first piston assembly when pressure decreases across the first piston assembly; and closing the by-pass across the second piston assembly to increase pressure across the second piston assembly.

13. The method of claim 12, wherein the first piston assembly is downhole from the second piston assembly.

14. The method of claim 12, wherein decreasing pressure across the first piston assembly comprises displacing the first piston assembly across a lateral break.

15. The method of claim 12, further comprising:

displacing the first piston assembly and the second piston assembly axially down the wellbore in the first direction maintaining the first annulus; and increasing pressure across the first piston assembly, wherein increasing pressure across the first piston assembly comprises:

sealingly engaging the first piston assembly with the wellbore;

opening the by-pass across the second piston assembly; and closing the by-pass across the first piston assembly.

16. The method of claim 12, wherein the first piston assembly comprises a first piston disposed about a tubular string, and wherein the second piston assembly comprises a second piston disposed about the tubular string.

17. The method of claim 16, wherein the tubular string comprising an electrical pathway configured to conduct electricity and supply electrical power to at least one of the first piston assembly, the second piston assembly, or the by-pass.

18. The method of claim 16, further comprising: supplying at least one signal through the tubular string to the by-pass.

19. The method of claim 18, further comprising:

receiving, by a processor, at least one input from at least one sensor; and generating the at least one signal in response to receiving the at least one input.

20. The method of claim 19, further comprising:

receiving at least one drilling operation parameter;

operating a pump in response to the at least one drilling operation parameter; and increasing pressure across the second piston assembly in response to operating the pump.

* * * * *